US008564631B2

(12) United States Patent
Taguchi et al.

(10) Patent No.: US 8,564,631 B2
(45) **Date of Patent: *Oct. 22, 2013**

(54) IMAGE ERASING APPARATUS AND CONTROL METHOD FOR IMAGE ERASING APPARATUS

(75) Inventors: Hiroyuki Taguchi, Shizuoka-ken (JP); Isao Yahata, Shizuoka-ken (JP); Ken Iguchi, Shizuoka-ken (JP); Takahiro Kawaguchi, Shizuoka-ken (JP); Hiroyuki Tsuchihashi, Shizuoka-ken (JP); Hiroyuki Taki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/620,176

(22) Filed: Sep. 14, 2012

(65) Prior Publication Data

US 2013/0010046 A1 Jan. 10, 2013

Related U.S. Application Data

(63) Continuation of application No. 13/042,119, filed on Mar. 7, 2011, now Pat. No. 8,289,353.

(60) Provisional application No. 61/318,726, filed on Mar. 29, 2010.

(51) Int. Cl.
*B41J 2/32* (2006.01)

(52) U.S. Cl.
USPC ..... 347/179

(58) Field of Classification Search
USPC ..... 347/179; 400/695, 699
See application file for complete search history.

(56) References Cited

U.S. PATENT DOCUMENTS

| | | | | |
|---|---|---|---|---|
| 6,739,591 | B2 | 5/2004 | Chujo et al. | |
| 7,331,578 | B2 | 2/2008 | Sano et al. | |
| 7,613,406 | B2 | 11/2009 | Takeda | |
| 8,115,976 | B2 | 2/2012 | Murakami | |
| 8,289,353 | B2 * | 10/2012 | Taguchi et al. | 347/179 |
| 2005/0269759 | A1 | 12/2005 | Sano et al. | |
| 2005/0275162 | A1 | 12/2005 | Sano et al. | |
| 2006/0245768 | A1 | 11/2006 | Takeda et al. | |
| 2007/0165094 | A1 * | 7/2007 | Matsumura et al. | 347/223 |
| 2009/0103147 | A1 | 4/2009 | Murakami | |
| 2010/0321456 | A1 | 12/2010 | Tsuchihashi et al. | |

(Continued)

FOREIGN PATENT DOCUMENTS

| | | |
|---|---|---|
| JP | 08-076534 | 3/1996 |
| JP | 08-091602 | 4/1996 |

(Continued)

*Primary Examiner* — Huan Tran
(74) *Attorney, Agent, or Firm* — Patterson & Sheridan, LLP

(57) ABSTRACT

An image erasing apparatus includes: a supply unit which supplies a recording medium; a collection unit which collects the recording medium supplied by the supply unit; plural carrying roller pairs which carry the recording medium supplied by the supply unit, toward the collection unit; a detection unit which acquires information about a metallic foreign matter adhering to the recording medium; a heating unit which heats the recording medium to a color erasing temperature of a developer or higher; and a carrying control unit which decelerates a rotation speed of the plural carrying roller pairs from a first speed to a second speed when the information about the metallic foreign matter is acquired by the detection unit.

10 Claims, 5 Drawing Sheets

(56) References Cited

U.S. PATENT DOCUMENTS

| | | | |
|---|---|---|---|
| 2010/0321457 | A1 | 12/2010 | Kawaguchi et al. |
| 2010/0323287 | A1 | 12/2010 | Yahata et al. |
| 2011/0074901 | A1 | 3/2011 | Tsuchihashi et al. |
| 2011/0234736 | A1 | 9/2011 | Taguchi et al. |

FOREIGN PATENT DOCUMENTS

| | | |
|---|---|---|
| JP | 2000-095390 | 4/2000 |
| JP | 2007-065501 | 3/2007 |
| JP | 2009-137716 | 6/2009 |

* cited by examiner

IMAGE ERASING APPARATUS AND CONTROL METHOD FOR IMAGE ERASING APPARATUS

CROSS-REFERENCE TO RELATED APPLICATION

This application is a continuation of U.S. patent application Ser. No. 13/042,119, filed Mar. 7, 2011, which is based upon and claims the benefit of priority from U.S. provisional application 61/318,726, filed on Mar. 29, 2010; the entire contents of which are incorporated herein by reference.

FIELD

Embodiments described herein relate generally to an image erasing apparatus which erases an image formed on a recording medium, and a control method for the image erasing apparatus.

BACKGROUND

There is an image erasing apparatus which erases an image formed on a recording medium, by heating the image with a heating device. In the image erasing apparatus of this type, the image is erased while the supplied recording medium is carried by carrying rollers, and the recording medium from which the image is erased is collected into a stack device. In some cases, plural recording media that are still bound together with a metallic foreign matter such as staple or clip are supplied to the image erasing apparatus. In such cases, the staple abuts the carrying rollers and a large load is applied to the carrying rollers.

DETAILED DESCRIPTION

According to an embodiment, an image erasing apparatus includes: a supply unit which supplies a recording medium; a collection unit which collects the recording medium supplied by the supply unit; plural carrying roller pairs which are situated along a carrying path through which the recording medium supplied by the supply unit is carried toward the collection unit, with each of the carrying roller pairs nipping and pressing the recording medium and thus carrying the recording medium; a detection unit which acquires information about a metallic foreign matter adhering to the recording medium, at a first position in the carrying path; a heating unit which is situated at a second position downstream in a carrying direction from the first position in the carrying path and heats the recording medium to a color erasing temperature of a developer or higher; and a carrying control unit which decelerates a rotation speed of the plural carrying roller pairs from a first speed to a second speed when the information about the metallic foreign matter is acquired by the detection unit.

First Embodiment

Figure 1:
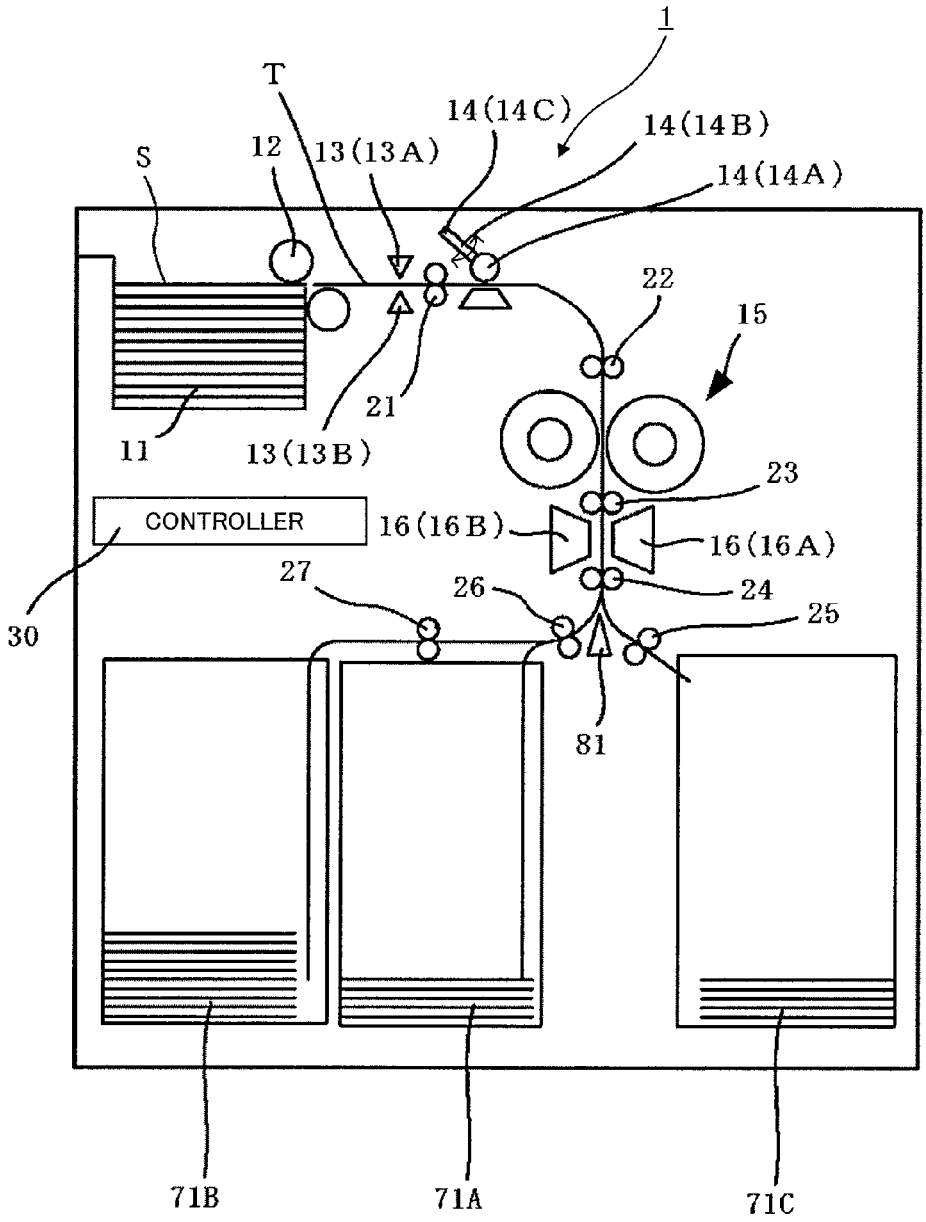
FIG. 1 is a sectional view of an image erasing apparatus.

FIG. 1 is a sectional view of an image erasing apparatus according to this embodiment, showing some necessary elements for explanation in a perspective manner. An image erasing apparatus 1 of this embodiment includes a paper supply tray 11, a pickup roller 12, a multi-feed detection sensor 13, a medium sensor 14, a heating device 15, a scanner 16, plural roller pairs 20, and a controller 30.

Many recording media (sheets) S are stacked on the paper supply tray 11. An image is drawn with a developer on the recording media S. The pickup roller 12 picks up the recording media S stacked on the paper supply tray 11 and supply the recording media S to a recording medium carrying path T. The pickup operation of the pickup roller 12 is controlled by the controller 30. Here, the pickup roller 12 may pick up the recording media S stacked on the paper supply tray 11 one by one, or may pick up the entire stack of plural recording media S together. In the case of picking up the plural recording media S together, these recording media S may be bound together with a staple or clip.

The multi-feed detection sensor 13 detects multi-feed of the recording media S. The multi-feed detection sensor 13 includes a transmission sensor 13A and a receiving sensor 13B. The transmission sensor 13A outputs ultrasonic waves. The receiving sensor 13B receives the ultrasonic waves outputted by the transmission sensor 13A. The ultrasonic waves are damped when passing through the recording media S. The controller 30 determines whether there is multi-feed or not, based on an output waveform of a signal outputted by the receiving sensor 13B.

The medium sensor 14 has an abutting part 14A and a fluctuating bar 14B. One end of the fluctuating bar 14B has the abutting part 14A, and its other end has an axis part 14C. The fluctuating bar 14B fluctuates in the direction of the arrow about the axis part 14C as its rotation axis. When the multi-fed plural recording media S reach a detection position of the medium sensor 14, the rotation angle of the fluctuating bar 14B becomes greater than when a single recording medium S reaches there. The controller 30 determines whether there is a multi-feed or not, based on the rotation angel of the fluctuating bar 14B.

The carrying path T extends horizontally from a starting end in the carrying direction and bends downward at a position between the medium sensor 14 and the heating device 15.

The heating device 15 is situated downstream in the carrying path T from the medium sensor 14. The heating device 15 includes a first heating device 15A and a second heating device 15B. The first heating device 15A and the second heating device 15B face each other across the carrying path T. The heating device 15 heats the recording media S to a color erasing temperature or higher at which the color of the developer disappears, and thus erases the image formed on the recording media S.

The scanner 16 is situated downstream in the carrying path T from the heating device 15. The scanner 16 includes a first scanner 16A and a second scanner 16B. The first scanner 16A and the second scanner 16B face each other across the carrying path T. The controller 30 determines whether image erasure on the recording media S is successful or not, based on an output from the scanner 16.

The image erasing apparatus 1 has stack devices 71A, 71B and 71C in which the recording media S are accumulated, downstream in the carrying direction from the scanner 16. The controller 30 operates a switching device 81 so that the recording media S on which image erasure is not successful are stacked in the stack device 71C, whereas the recording media S on which image erasure is successful are sorted by the size of the recording media and stacked in the stack device 71A or the stack device 71B.

Plural roller pairs 21 to 27 are situated along the carrying path T. The first roller pair 21 is situated between the multi-feed detection sensor 13 and the medium sensor 14. The first roller pair 21 rotates in the state of nipping and pressing the recording medium S passing the multi-feed detection sensor 13, and thus carries the recording medium S toward the medium sensor 14. The second roller pair 22 is situated between the medium sensor 14 and the heating device 15. The second roller pair 22 rotates in the state of nipping and pressing the recording medium S which passed the medium sensor 14, and thus carries the recording medium S toward the heating device 15.

The third roller pair 23 is situated between the heating device 15 and the scanner 16. The third roller pair 23 rotates in the state of nipping and pressing the recording medium S which passed the heating device 15, and thus carries the recording medium S toward the fourth roller pair 24. The fourth roller pair 24 carries the recording medium S which passed the scanner 16 toward one of the stack devices 71A, 71B and 71C. The fifth roller pair 25 carries the recording medium S carried from the fourth roller pair 24, to the stack device 71C. The sixth roller pair 26 carries the recording medium S carried from the fourth roller pair 24, to the stack device 71A. The seventh roller pair 27 carries the recording medium S carried from the fourth roller pair 24, to the stack device 71B.

The controller 30 executes various controls to be performed in the image erasing apparatus 1. The controller 30 may be a CPU or MPU. The controller 30 may be an ASIC circuit which executes at least of a part of processing realized by a CPU or MPU in a circuit-based manner. The number of these CPUs, MPUs and ASIC circuits is not particularly specified. Different CPUs may perform control, depending on the contents of control. The controller 30 may also include other elements necessary for control.

Figure 2:
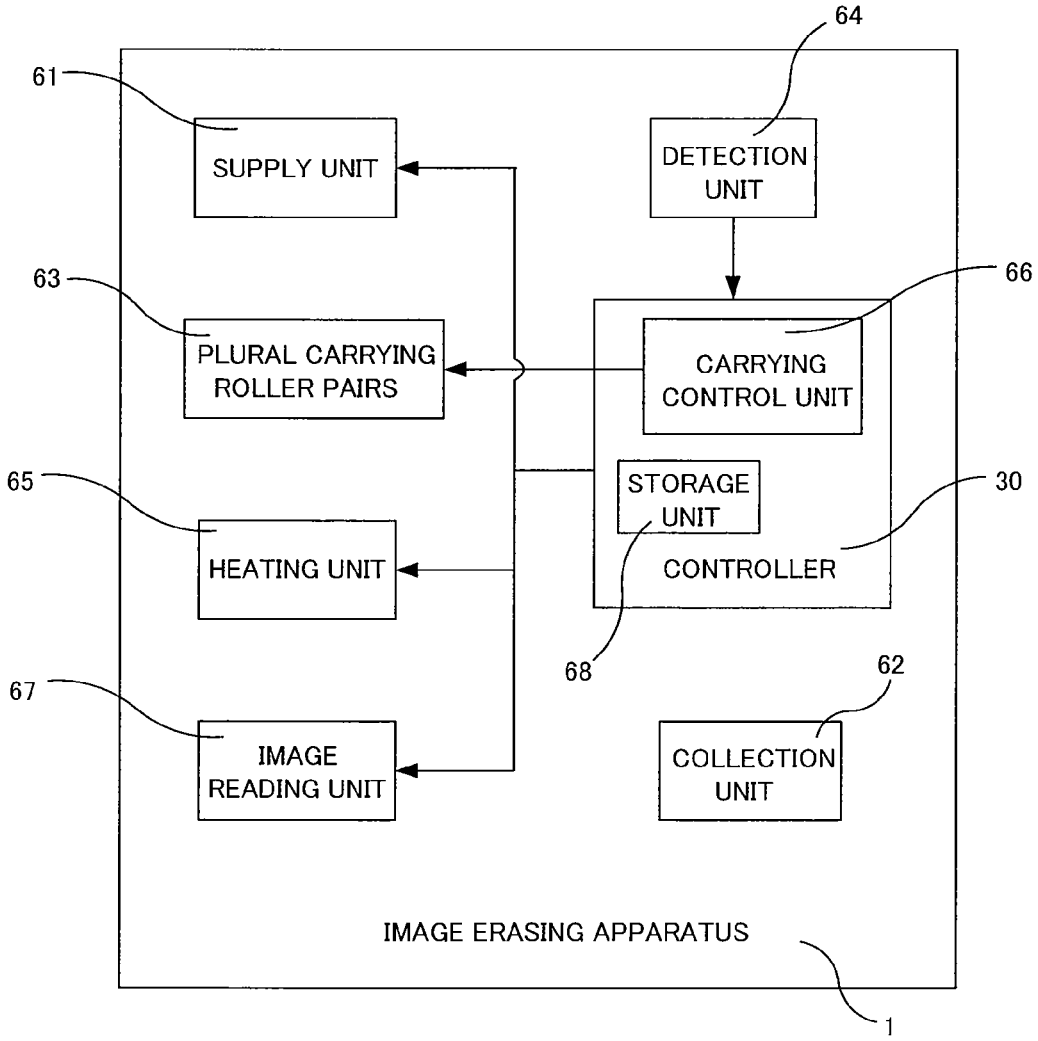
FIG. 2 is a functional block diagram of the image erasing apparatus.

Next, an example of a configuration to realize this embodiment is shown in the block diagram of FIG. 2. The image erasing apparatus 1 has a supply unit 61, a collection unit 62, plural carrying roller pairs 63, a detection unit 64, a heating unit 65, a carrying control unit 66, an image reading unit 67, and a storage unit 68.

The supply unit 61 supplies the recording media S to the carrying path T in the image erasing apparatus 1. With reference to FIG. 1 and FIG. 2, the supply unit 61 may be realized by the paper supply tray 11, the pickup roller 12 and a motor that drives the pickup roller 12 in cooperation with each other. The collection unit 62 collects the recording media S supplied by the supply unit 61. With reference to FIG. 1 and FIG. 2, the collection unit 62 may be the stack devices 71A, 71B and 71C. The number of the stack devices is not limited to the embodiment shown in FIG. 1. For example, there may be a single stack device.

The plural carrying roller pairs 63 are situated along the carrying path T through which the recording media S supplied by the supply unit 61 are carried toward the collection unit 62, and each carrying roller pair nips and presses the recording media S and thus carries the recording media S. With reference to FIG. 1 and FIG. 2, the plural carrying roller pairs 63 may be the plural roller pairs 21 to 27. The number of the plural carrying roller pairs 63 is not limited to the embodiment shown in FIG. 1.

The detection unit 64 acquires information about a metallic foreign matter adhering to the recording media S, at the first position in the carrying path T. The metallic foreign matter may be a binding member to bind the plural recording media S that are superimposed. The binding member may be a staple or clip. The detection unit 64 outputs the result of the detection to the controller 30.

The detection unit 64 may employ a method of directly detecting the metallic foreign matter or a method of indirectly detecting the metallic foreign matter. The detection unit 64 employing the method of directly detecting the metallic foreign matter may be an image pickup unit which picks up an image of the foreign matter. The image pickup unit will be described in a second embodiment. With reference to FIG. 1 and FIG. 2, the detection unit 64 employing the method of indirectly detecting the metallic foreign matter may be one or both of the multi-feed detection sensor 13 and the medium sensor 14. The plural recording media S bound together with a staple or the like are multi-fed. Therefore, whether there is a staple or not is determined, based on the result of the detection by the multi-feed detection sensor 13 and the medium sensor 14. The first position may be further upstream from the first roller pair 21 that is at the most upstream position in the carrying path T, of the plural roller pairs 21 to 27. Thus, all the roller pairs 21 to 27 are protected from the metallic foreign matter adhering to the recording media S. Details will be described later.

The heating unit 65 is situated at the second position downstream in the carrying direction from the first position in the carrying path T, and heats the recording media S to the color erasing temperature of the developer or higher. With reference to FIG. 1 and FIG. 2, the heating unit 65 may be the heating device 15.

The carrying control unit 66 decelerates the rotation speed of the plural carrying roller pairs 63 from the first speed to the second speed when the information about the metallic foreign matter is acquired by the detection unit 64. With reference to FIG. 1, the plural carrying roller pairs 63 whose speed is decelerated to the second speed may be the roller pairs 21 to 27.

The image reading unit 67 reads an image of the recording media S and thus acquires information about whether the color of the developer is erased or not. With reference to FIG. 1, the image reading unit 67 may be the scanner 16.

In the storage unit 68, a program for carrying out various controls in the image erasing apparatus 1 is stored. The storage unit 68 may be an HDD and memory. The controller 30 reads out and decodes the program stored in the HDD. The storage unit 68 may be situated outside of the controller 30.

Figure 3:
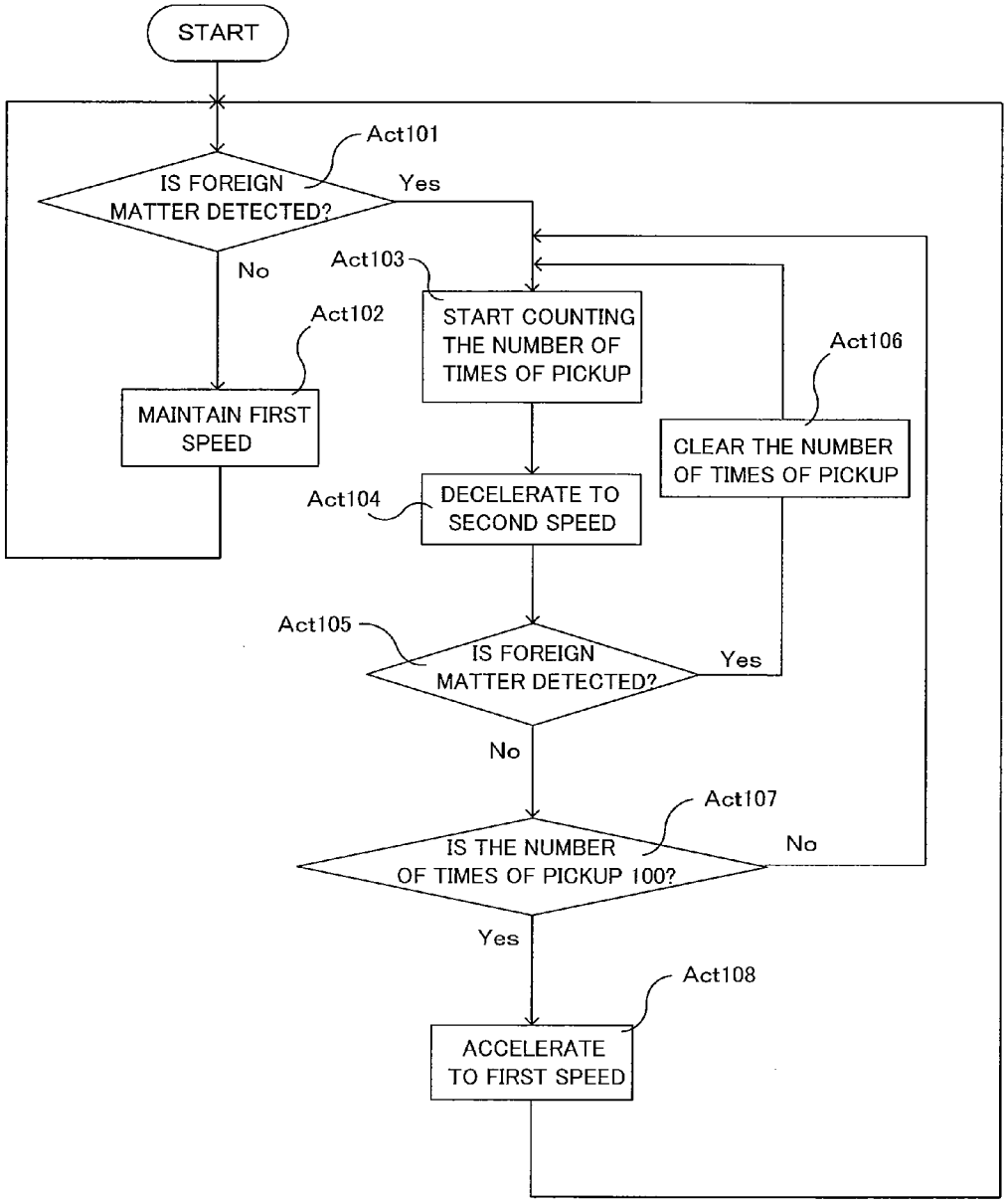
FIG. 3 is a flowchart showing the operation of the image erasing apparatus.

Next, the operation of the image erasing apparatus 1 will be described with reference to the flowchart of FIG. 3. In an initial state, the speed of the roller pairs 21 to 27 is assumed to be set to the first speed. It is also assumed that the multi-feed detection sensor 13 is used as the detection unit 64. The first speed may be the maximum speed of the roller pairs 21 to 27. In ACT 101, the controller 30 determines whether the recording media S are multi-fed or not, based on a signal outputted by the multi-feed detection sensor 13. When the recording media S are multi-fed, the processing goes to ACT 102. When the recording media S are not multi-fed, the processing goes to ACT 103.

In ACT 102, the controller 30 maintains the speed of the roller pairs 21 to 27 at the first speed. In ACT 103, the controller 30 counts the number of times of pickup by the pickup roller 12 and sequentially stores the number of times of pickup in the storage unit 68.

In ACT 104, the controller 30 decelerates the speed of the roller pairs 21 to 27 from the first speed to the second speed. Thus, the impact of abutment of a staple against the roller pairs 21 to 27 is weakened and the roller pairs 21 to 27 are protected. Moreover, the impact of abutment of the staple against the scanner 16 is weakened and the scanner 16 is protected. The second speed may be the minimum speed of the roller pairs 21 to 27.

In ACT 105, the controller 30 determines whether the recording media S are multi-fed or not, based on a signal outputted by the multi-feed detection sensor 13. When the recording media S are multi-fed, the processing goes to ACT 106. When the recording media S are not multi-fed, the processing goes to ACT 107.

In ACT 106, the controller 30 clears the number of times of pickup stored in the storage unit 68 and returns to ACT 103. In ACT 107, the controller 30 determines whether the number of times of pickup by the pickup roller 12 is already a predetermined number of times or not. Here, the predetermined number of times may be 100 as determined in advance. When the number of times of pickup is already 100, the processing goes to ACT 108. When the number of times of pickup is less than 100, the processing returns to ACT 103. However, it is also possible to maintain the second speed (decelerating state) until the erasure on all the recording media S stacked on the paper supply tray 11 is completed, without defining the predetermined number of times.

In ACT 108, the controller 30 accelerates the rotation speed of the roller pairs 21 to 27 from the second speed to the first speed. As the rotation speed of the roller pairs 21 to 27 is thus accelerated to the original speed after the erasure on a predetermined number of the recording media S, productivity is improved. Moreover, the rotation speed of the roller pairs 21 to 27 is maintained in the decelerating state until the erasure on the predetermined number of the recording media S is carried out after the recording media S with a staple adhering thereto are carried. Thus, the roller pairs 21 to 27 and the scanner 16 are protected even when the stapled recording media S are continuously supplied.

Second Embodiment

Figure 4:
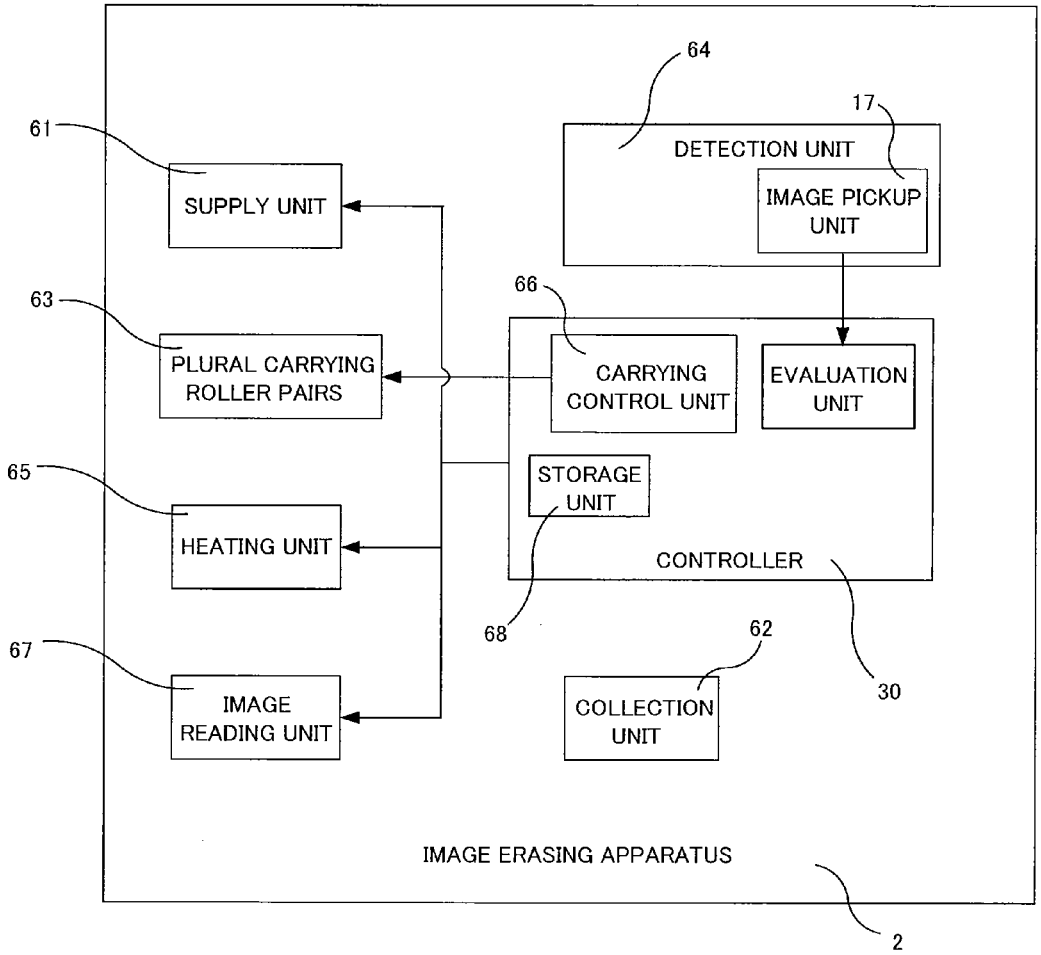
FIG. 4 is a functional block diagram of an image erasing apparatus according to a second embodiment.

FIG. 4 is a block diagram of an image erasing apparatus 2 according to this embodiment. The elements having the same functions as in the first embodiment are denoted by the same reference numerals. This embodiment is different from the first embodiment in the configuration of the detection unit 64 and the controller 30.

The detection unit 64 according to this embodiment has an image pickup unit 17. With reference to FIG. 1, the image pickup unit 17 is situated upstream in the carrying path T from the multi-feed detection sensor 13. The image pickup unit 17 picks up an image of the recording media S supplied into the carrying path T and outputs image data of the recording media S to an evaluation unit 69 in the controller 30. The image pickup unit 17 emits light to the recording media S and receives the reflected light with an image pickup element, thus acquiring image data. The image pickup element may be a CCD sensor or CMOS sensor.

The evaluation unit 69 analyzes the image data outputted by the image pickup unit 17, determines whether a staple is adhering to the recording media S or not, and also evaluates the size of the adhering staple.

Figure 5:
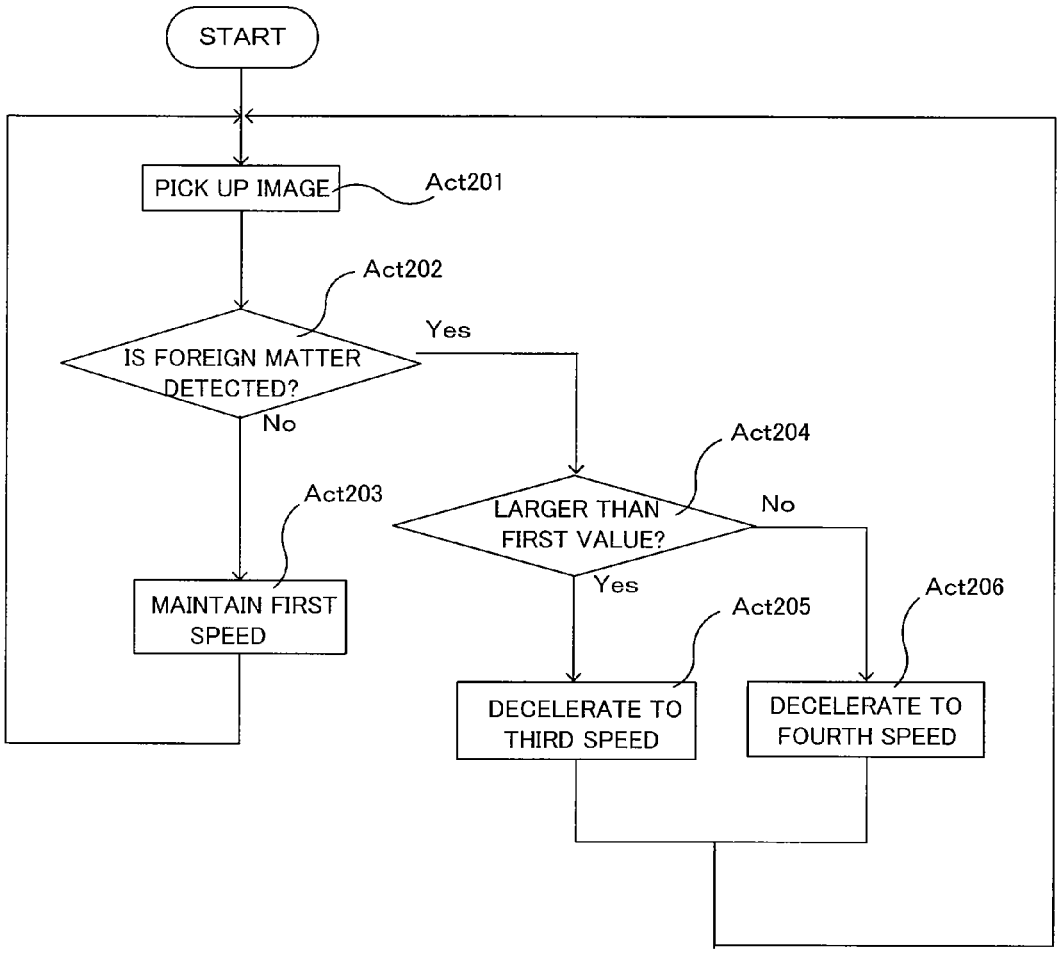
FIG. 5 is a flowchart showing the operation of the image erasing apparatus according to the second embodiment.

Next, the operation of the image erasing apparatus 2 according to this embodiment will be described with reference to the flowchart of FIG. 5. In an initial state, the speed of the roller pairs 21 to 27 is assumed to be set to a first speed. The first speed may be the maximum speed of the roller pairs 21 to 27. In ACT 201, the image pickup unit 17 picks up an image of the recording media S and outputs image data to the evaluation unit 69. In ACT 202, the evaluation unit 69 determines whether a staple is detected or not, and also specifies the size of the staple. When no staples are detected, the processing goes to ACT 203. When a staple is detected, the processing goes to ACT 204. In ACT 203, the controller 30 maintains the rotation speed of the roller pairs 21 to 27 at the first speed.

In ACT 204, the evaluation unit 69 determines whether the size of the detected staple is greater than a first value or not. Here, the first value may be a design value. When the size of the staple is greater than the first value, the processing goes to ACT 205. When the size of the staple is smaller than the first value, the processing goes to ACT 206.

In ACT 205, the controller 30 decelerates the rotation speed of the roller pairs 21 to 27 from the first speed to a third speed. In ACT 206, the controller 30 decelerates the rotation speed of the roller pairs 21 to 27 from the first speed to a fourth speed. Here, the fourth speed is faster than the third speed. In this manner, the amount of deceleration is made small when the size of the staple is small, whereas the amount of deceleration is made large when the size of the staple is large. Thus, both maintenance of productivity and protection of the roller pairs 21 to 27 and the scanner 16 are realized.

In this embodiment, similarly to the first embodiment, there may be a sequence for improving productivity that is temporarily lowered by decelerating the rotation speed of the roller pairs 21 to 27.

While certain embodiments have been described, these embodiments have been presented by way of example only, and are not intended to limit the scope of invention. Indeed, the novel apparatus described herein may be embodied in a variety of other forms; furthermore, various omissions, substitutions and changes in the form of the apparatus described herein may be made without departing from the sprit of the inventions. The accompanying claims and their equivalents are intended to cover such forms or modifications as would fall within the scope and spirit of the inventions.

What is claimed is:

1. An image erasing apparatus comprising:

a supply unit from which a sheet is supplied;

a collection unit configured to store the sheet supplied from the supply unit;

a carrying unit provided along a carrying path through which the sheet supplied from the supply unit is conveyed toward the collection unit, the carrying unit being configured to convey the sheet while nipping and pressing the sheet;

a sensor configured to detect a multi-feed of sheets, at a first position along the carrying path;

an erasing unit provided at a second position downstream in a carrying direction with respect to the first position along the carrying path and configured to erase an image formed on a sheet; and a control unit configured to cause a conveying speed of sheets to be decreased from a first speed to a second speed in response to the multi-feed of sheets detected by the sensor such that the sheets are conveyed to the erasing unit at the second speed.

2. The apparatus according to claim 1, wherein the erasing unit is configured to erase the image by heating the image to a color erasing temperature or higher.

3. The apparatus according to claim 1, wherein the control unit is configured to cause the conveying speed to be increased from the second speed to the first speed when a predetermined number of sheets are conveyed consecutively without the multi-feed of sheets.

4. An image erasing apparatus comprising:

a supply unit from which a sheet is supplied;

a collection unit configured to store the sheet supplied from the supply unit;

a carrying unit provided along a carrying path through which the sheet supplied from the supply unit is conveyed toward the collection unit, the carrying unit being configured to convey the sheet while nipping and pressing the sheet;

a sensor which detects configured to detect an entire thickness of one or more sheets passing therethrough, at a first position along the carrying path;

an erasing unit provided at a second position downstream in a carrying direction with respect to the first position along the carrying path and configured to erase an image formed on a sheet; and a control unit configured to cause a conveying speed of sheets to be decreased from a first speed to a second speed in response to a multi-feed of sheets determined based on the thickness detected by the sensor such that the sheets are conveyed to the erasing unit at the second speed.

5. The apparatus according to claim 4, wherein the erasing unit is configured to erase the image by heating the image to a color erasing temperature or higher.

6. The apparatus according to claim 4, wherein the control unit is configured to cause the conveying speed to be increased from the second speed to the first speed when a predetermined number of sheets are conveyed consecutively without the multi-feed of sheets.

7. A control method for an image erasing apparatus comprising:

a carrying unit provided along a carrying path and configured to convey a sheet passing through the carrying path; and an erasing unit provided along the carrying path and configured to erase an image formed on a sheet, the method comprising:

detecting at least one of a multi-feed of sheets and an entire thickness of one or more sheets conveyed by the carrying unit at a position upstream in a carrying direction with respect to the erasing unit along the carrying path;

causing a conveying speed of the sheets to be decreased from a first speed to a second speed based on said detecting of the multi-feed of sheets or the entire thickness of sheets, such that the sheets are conveyed to the erasing unit at the second speed.

8. The method according to claim 7, further comprising:

causing the carrying speed to be increased from the second speed to the first speed when a predetermined number of sheets are conveyed consecutively without the multi-feed of sheets.

9. An apparatus comprising:

a supply unit from which a sheet is supplied;

a collection unit configured to store the sheet supplied from the supply unit;

a carrying unit provided along a carrying path through which the sheet supplied from the supply unit is conveyed toward the collection unit, the carrying unit being configured to convey the sheet while nipping and pressing the sheet;

a sensor configured to detect a multi-feed of sheet, at a first position along the carrying path;

an image reading unit provided at a position downstream in a carrying direction with respect to the first position along the carrying path and configured to read an image formed on the sheet; and a control unit configured to cause a conveying speed of sheets to be decreased from a first speed to a second speed in response to the multi-feed of sheet detected by the sensor such that the sheets are conveyed to the image reading unit at the second speed.

10. The apparatus according to claim 9, further comprising:

an erasing unit provided along the carrying path between the first position and the image reading unit and configured to erase an image formed on a sheet.

* * * * *